US006464296B2

(12) United States Patent
Sumner

(10) Patent No.: US 6,464,296 B2
(45) Date of Patent: Oct. 15, 2002

(54) THERAPEUTIC INVERSION CHAIR

(76) Inventor: Elaine Sumner, 1705 Shephard Apartments, 535-24th Street, E., Saskatoon, Saskatchewan (CA), S7K 4K5

( * ) Notice: Subject to any disclaimer, the term of this patent is extended or adjusted under 35 U.S.C. 154(b) by 44 days.

(21) Appl. No.: 09/737,853

(22) Filed: Dec. 18, 2000

(65) Prior Publication Data

US 2001/0004165 A1 Jun. 21, 2001

(30) Foreign Application Priority Data

Dec. 17, 1999 (CA) ..... 2292692

(51) Int. Cl.[7] ..... A47C 1/02
(52) U.S. Cl. ..... 297/326; 297/330
(58) Field of Search ..... 297/3, 1, 325, 297/326, 327, 344.18, 302.1, 487, 328, 330, 488, 258.1; 482/143, 144; 601/24

(56) References Cited

U.S. PATENT DOCUMENTS 1,922,418 A * 8/1933 Conant
3,635,526 A * 1/1972 Posey
3,986,499 A 10/1976 Fischer
4,103,681 A 8/1978 Shanley
4,214,790 A 7/1980 Sieber
4,410,176 A * 10/1983 Miller
4,561,692 A * 12/1985 Yestadt et al.
4,739,749 A 4/1988 Lindley
5,334,123 A * 8/1994 Rutherford
5,449,334 A * 9/1995 Kingsbury
5,527,096 A * 6/1996 Shimer
5,575,745 A * 11/1996 Lin
5,967,956 A * 10/1999 Teeter
6,050,642 A * 4/2000 Erb

FOREIGN PATENT DOCUMENTS

CA 1199544 1/1986

OTHER PUBLICATIONS

Brochure entitled "The Back Revolution System" (1 page).
Brochure entitled "Bac–Trac" (2 pages).

* cited by examiner

*Primary Examiner*—Milton Nelson, Jr.
(74) *Attorney, Agent, or Firm*—Ryan W. Dupuis; Adrian D. Battison; Michael R. Williams

(57) ABSTRACT

A method and apparatus is provided for inverting a person for various therapeutic purposes. The apparatus comprises a chair which is pivotally supported about a horizontal axis between various positions having different relative inclinations. When used for inversion, a stop is mounted on the chair to restrict rearward pivotal movement of the person from an upright position to an inverted position. The method thus includes pivoting the person forwardly from the upright position to the inverted position in which the person is substantially inverted in relation to the upright position. The chair may further include a damper and a biasing device for dampering the pivotal displacement of the chair and biasing the chair to the upright position. A lift mechanism may further be used for raising the chair in the inverted position.

20 Claims, 6 Drawing Sheets

THERAPEUTIC INVERSION CHAIR

FIELD OF THE INVENTION

This invention relates to a chair arranged to support a person thereon such that the person may be inverted for therapeutic purposes.

BACKGROUND

Inversion devices such as inversion chairs and tables are known for therapeutic purposes and particularly for the treatment of a person's spine to relieve pain and tension from the spine by inverting the person supported thereon. These devices generally comprise a frame and a support pivotally mounted on the frame such that a person may be supported thereon for pivotal movement between an upright position and an inverted position. The devices generally require a person to pivot themselves in a rearward direction from the upright position to the inverted position such that the person faces upward as they are pivoted. This often results in a situation where the person is pivoted in an uncontrolled manner which may result in injury as there is no fixed support structure within reach of the person as they are pivoted. This rearward rotation can also cause significant disorientation.

One inversion device known as the Bac-Trac, provides a frame which supports a lap pad above the ground for pivotal movement about a horizontal axis. In use, a person stands adjacent the frame such that the lap pad extends laterally across their waist. The person then pivots themselves forwardly with the pad about the horizontal axis while being supported entirely by the unstable mounted lap pad. A laterally extending safety bar is arranged to extend across the back of the person's knees once the person has inverted themselves about the horizontal axis. The lap pad however, is arranged to pivot freely in either direction and requires significant strength and control on the part of the user to guide themselves through the inversion as the device provides no support to the person other than across the waist and across the back of the knees. This type of inversion is unsuitable for persons who are not already considerably fit.

SUMMARY

According to one aspect of the present invention there is provided an inversion chair for inverting a person supported thereon, the chair comprising:

a frame;

a seat pivotally mounted on the frame for pivotal movement between an upright position and an inverted position in which the seat is substantially inverted relative to the upright position, the seat being arranged to support the person thereon;

a restraint coupled to the seat and being arranged to restrain the person within the seat as the seat is pivotally displaced from the upright position to the inverted position; and a stop member restricting rearward pivotal rotation of the seat from the upright position to the inverted position;

whereby the seat rotates forwardly and faces downwardly as the seat is displaced from the upright position to the inverted position.

The inversion chair allows a person to be inverted from the upright position to the inverted position by pivoting the chair in a forward direction. By pivoting the chair forwardly, a fixed supporting structure such as the frame of the chair or the ground beneath the chair is within reach of the person in the chair during the entire movement between the upright and inverted positions. This allows the movement to be executed in a controlled manner for reducing possible risk of injury as a result of the chair tipping in an uncontrollable manner. Furthermore, forward rotation is a more natural movement that rearward rotation, resulting in less mental resistance to the inversion process and thus better relaxation is achieved for optimal results for both disabled and able bodied users.

There may be provided a locking member mounted on the frame arranged to engage the stop member, the locking member being selectively separable from the frame to permit displacement of the seat in both forward and rearward directions in relation to the frame when the locking member is removed.

Preferably there is provided various mounting locations for the locking member each corresponding to a relative orientation of the seat in relation to the frame.

For use as a rocking therapy, there may be provided a rearward locking member mounted on the frame arranged to engage the stop member in a reclined position in which the seat extends at a rearward incline in relation to the upright position and a forward locking member mounted on the frame arranged to engage the stop member in a forward inclined position in which the seat extends at a forward incline in relation to the upright position. The seat is thus arranged to pivot freely between the reclined position and the forward inclined position. Rocking therapy involves rocking forward and back to relieve the constant pressure on the spine.

To be used for drafting and the like, there may be provided a forward locking member mounted on the frame arrange to engage the stop member in a forward inclined position in which the seat extends at a forward incline in relation to the upright position, the locking member being arranged to restrict displacement of the seat in relation to the frame. A person may then be supported on the chair at a forward incline in relation to a substantially level table top. Additional restraints may be used for securing the legs and upper torso of the person in the chair when the seat is inclined forwardly when drafting and the like.

For use as an inversion chair, there may be provided an upper locking member mounted on the frame arranged to engage the stop member in the upright position for restricting rearward pivotal movement of the seat in the upright position and a lower locking member mounted on the frame arranged to engage the stop member in the inverted position for restricting rearward pivotal movement of the seat in the inverted position.

The frame preferably includes a lift mechanism arranged to raise the seat in the inverted position.

When the frame comprises a plurality of legs supporting the seat thereon, the lift mechanism preferably comprises an actuator associated with each leg for selectively extending a length of the leg to raise the seat. Alternatively, the pivot supporting the seat on the frame may be adjustable in relation to the ground by mounting the seat pivot on a track or the like which is supported on the frame. The seat may then be displaced vertically in relation to the frame which supports the seat above the ground.

A damper may be mounted between the seat and the frame for providing limited resistance to the relative pivotal movement therebetween.

The damper may comprise a pair of bushings pivotally supporting the seat on the frame. Suitable materials for the bushing include metal and carbon materials. Other forms of dampers may include fluid displacement type dampers and the like. A cam lock may also be provided for selecting the desired amount of resistance to pivotal movement. A damper would not be required in an automatically operated embodiment.

When using a damper in a manually operated embodiment, the seat is also preferably biased towards the upright position by a spring or other similar mechanism.

There may be provided a locking member arranged to secure the seat in the upright position.

The restraint preferably comprises a laterally extending support arranged to be secured across a lap of a person supported in the seat wherein the support includes an adjustable mounting mechanism arranged to mount the support at various spacings in relation to the seat.

A drive mechanism is preferably coupled between the seat and the frame controlling pivotal movement of the seat in relation to the frame. The drive mechanism preferably includes controls mounted on the seat which are arranged to be accessible to a person supported in the seat through a full range of motion of the seat in relation to the frame. The drive mechanism allows complete control of the inversion process by disabled persons without assistance or supervision being required. The drive mechanism preferably further includes an integral stop mechanism providing limits to the amount of rotation permitted and the direction of rotation permitted depending upon the angular position of the seat in relation to the frame.

The drive mechanism may include a seat lift mechanism arranged to raise the seat in the inverted position in relation to the upright position automatically as the seat is displaced between the upright position and the inverted position by the drive mechanism.

According to a further aspect of the present invention there is provided a method of inverting a person comprising;

providing a chair which is supported for pivotal movement about a substantially horizontal chair axis;

sitting the person on the chair to face in a forward direction;

restraining the person to the chair; and pivoting the chair about the chair axis in the forward direction from an upright position to an inverted position in which the chair is inverted about the chair axis in relation to the upright position such that the person faces downwardly as the chair is pivoted.

The method preferably includes restricting pivotal movement of the chair in a rearward direction when the chair is in the upright position.

A damper on the chair may be used to partially resist pivotal movement of the chair.

Pivotal movement of the chair is preferably biased towards the upright position.

The method may further include lifting the chair before it is pivoted into the inverted position.

Locking the chair in the inverted position may be desirable for ensuring the person in the chair is supported in a stable manner in the inverted position.

BRIEF DESCRIPTION OF THE DRAWINGS

In the accompanying drawings, which illustrate exemplary embodiments of the present invention.

DETAILED DESCRIPTION

Figure 1:
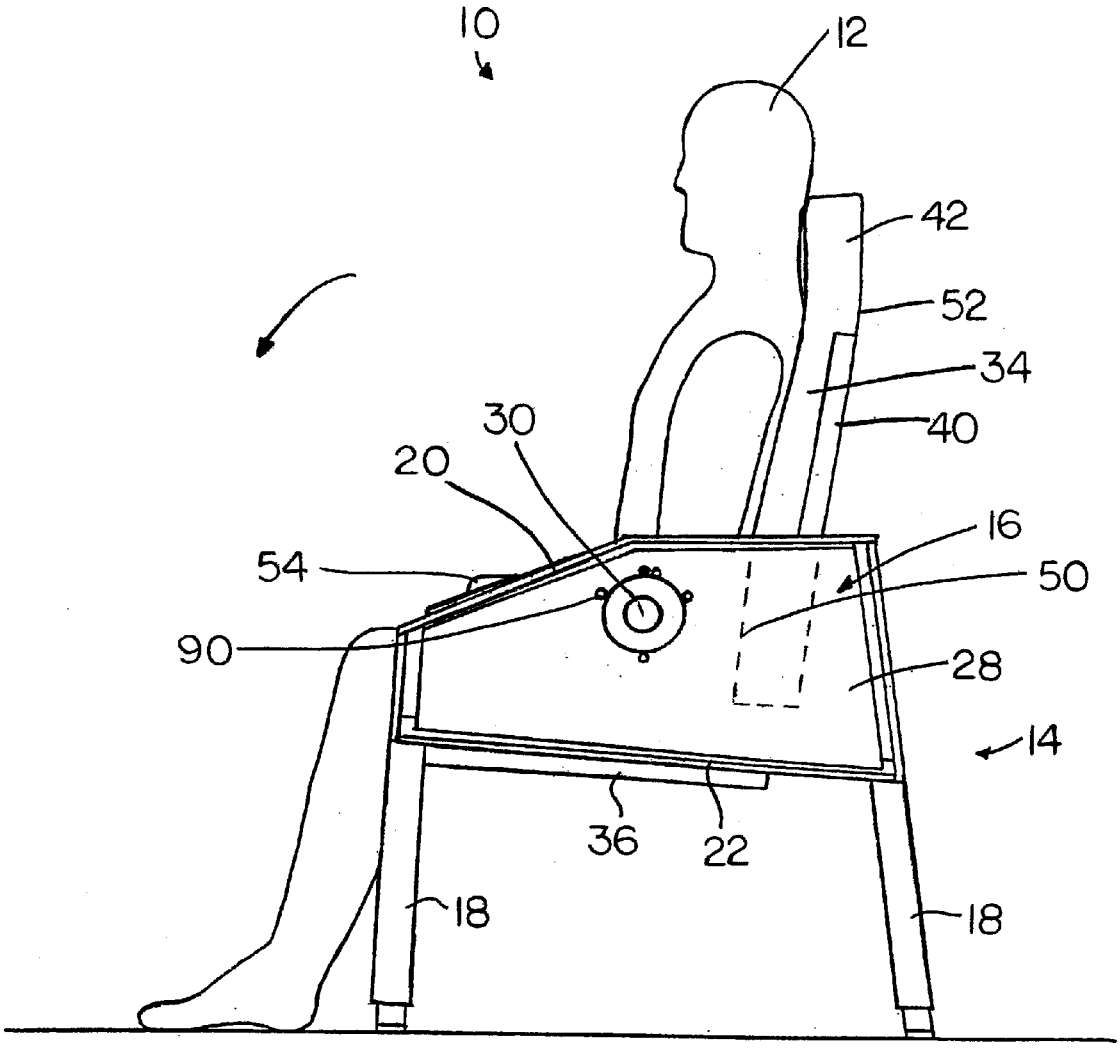
FIG. 1 is a side elevational view of the chair in an upright seated position.

Referring to the accompanying drawings, there is illustrated an inversion chair generally indicated by reference numeral 10. The inversion chair is arranged to support a person 12 thereon such that the person may be inverted for purposes of treating the spine of the person.

The chair 10 includes a frame 14 having a pair of upright and spaced apart sides 16. Each side 16 includes a pair of leg members 18 which are mounted, spaced apart in a generally upright orientation. The leg members are connected at a top end by an upper crossbar 20 which extends at a forward and downward incline between the respective top ends of the leg members. A lower crossbar 22 mounts between each pair of leg members 18 at a location spaced below the corresponding upper crossbar 20. The sides 16 formed from steel angles which have been bent, welded and appropriately finished.

The leg members 18 each comprise an extendable actuator. This may include an air driven piston cylinder or a hydraulic piston cylinder arrangement, either of which are arranged to be selectively extended for raising the chair as desired.

Each side 16 of the frame 14 includes frame panel 28 which is mounted between the upper and lower crossbars. Each frame panel 28 is arranged to mount a pivot mount 30 on an inner face thereof. The pivot mounts 30 are arranged to pivot about a horizontal chair axis 32 extending between the pivot mounts.

A seat 34 is mounted on the pivot mounts 30 for pivotal movement about the chair axis 32 relative to the frame 14. The seat 34 includes a seat bottom 36 which is supported on a pair of seat supports 38 which are mounted adjacent a bottom face of the seat bottom. The seat supports 38 are parallel and spaced apart and mount a pair of back supports 40 on a rearward end thereof to extend generally upward therefrom. The back supports 40 are parallel and spaced apart members which support a seat back 42 thereon. A pair of arm supports 44 are mounted on the respective back supports 40 spaced upwardly from the seat supports 38 to extend generally forward from the back supports. The arm supports 44 are connected at a forward end to the respective forward ends of the seat supports 38 by a pair of front supports extending therebetween.

A pair of seat panels 48 are mounted on the respective sides of the seat 34. Each seat panel 48, extends between a corresponding arm support 44 and a corresponding seat support 38. The seat panels 38 are perforated panels which are arranged to couple to the respective pivot mounts 30 for pivotally supporting the seat 34 on the frame. At least one of the seat panels 48 is removable with the use of fasteners such that the seat may easily be installed on the frame 14 upon assembly of the chair.

In a stationary upright position, the seat bottom 36 is arranged to extend at an upward angle at approximately 5 degrees from a rearward end to a forward end. The seat bottom is covered with a layer of fabric bonded to dense foamed neoprene which in turn is bonded to moulded 25 millimeter thick hardwood plywood.

In the upright position the seat back 42 is arranged to extend at an upward and rearward incline of approximately 78.5 degrees from horizontal. The seat back is also covered in fabric which is contoured over a 15 millimeter layer of soft foam bonded to a 19 millimeter layer of contoured hardwood plywood. A lower portion 50 of the seat back 42 is arranged to curve inwardly towards the person for providing additional support to the lower back. An upper portion 52 of the seat back is arranged to curve rearwardly and then forwardly adjacent the top end for supporting the shoulders and neck of a person in the chair.

A lap restraint 54, is mounted between respective sides of the seat for supporting the person in the seat in an inverted position in which the seat is inverted in relation to the upright position about the chair axis. The lap restraint includes a pair of upper lap bars 56 secured adjacent a bottom face of respective arm supports 44. A lower lap bar 58 is mounted spaced below each upper lap bar 56 by a respective lap panel 60. The upper and lower lap bars are connected at a forward end on the respective front supports of the seat, The upper and lower lap bars are connected at a rearward end by a respective rear lap bar 62, the supports and bars forming the seat 34 and the lap restraint 54 are formed from steel angles similarly to the frame 14.

A lap pad 64 is provided for coupling between the lap panels 60. The lap panels are perforated with numerous vertically and horizontally spaced apart mounting apertures for adjustably mounting the lap pad thereon. The lap pad 64 comprises a generally rectangular 25 millimeter thick hardwood plywood. A set of 4 barrel bolts 66 are mounted adjacent respective corners of the lap pad to extend laterally outward from respective sides 68 of the pad. The barrel bolts 66 are arranged to be received in corresponding mounting apertures in the respective lap panels.

A top side of the lap pad 64 is finished with a 6 millimeter particle board layer covered with a plastic laminant. A bottom side of the lap pad is covered by a 25 millimeter layer of dense upholstery foam followed by a 25 millimeter layer of medium dense upholstery foam. A cloth cover covers the two foams while a perimeter vinyl T conceals the edge of the plywood.

The leg members 18 are finished with an easily gripping surface to further provide control to the person as the person pivots themselves from the upright position to the inverted position.

The chair and chair axis are arranged such that both the center of mass of the chair and the center of mass of a person sitting in the chair are adjacent the chair axis. In this arrangement, the chair and the person remain balanced about the chair axis as the person is inverted with the chair about the chair axis. This provides minimal resistance to the rotation of the chair for optimal control of the rotation by the person in the chair with little effort required on the part of the person for further reducing risk of injury.

Each pivot mount 30 includes an axle 80 supported on the corresponding frame panel and a housing 82 mounted on the seat. The housing 82 is rotatably supported on the axle 80 and includes a bushing 84 which supports the housing on the axle. The bushing 84 acts as a damper to partially resist rotation of the seat in relation to the frame. A spring 86 is mounted between the axle 80 on the frame and the housing 82 on the seat. The spring 86 is arranged to bias the seat towards the upright position to assist a person in the inverted position in returning to a normal upright and seated position.

A stop 88 is mounted on the housing 82 for pivotal movement with the seat about the chair axis. The stop 88 includes an aperture therein arranged to receive a locking member 92 therethrough for securing the relative orientation of the seat to the frame. The locking member is arranged to be selectively separable from the frame to permit the seat to be secured at any one of numerous relative positions.

The frame panel 28 on each side includes a plurality of locking apertures spaced circumferentially about the chair axis for receiving one or plural locking members therethrough. The locking apertures 90 are in alignment with the aperture in the stop 88 so as to permit the locking member 92 to be inserted therethrough. Insertion of the locking member into one of the locking apertures 90 without inserting the locking member into the aperture in the corresponding stop 88 arranges the locking member to engage the stop 88 for limiting relative pivotal movement in one direction only.

Figure 2:
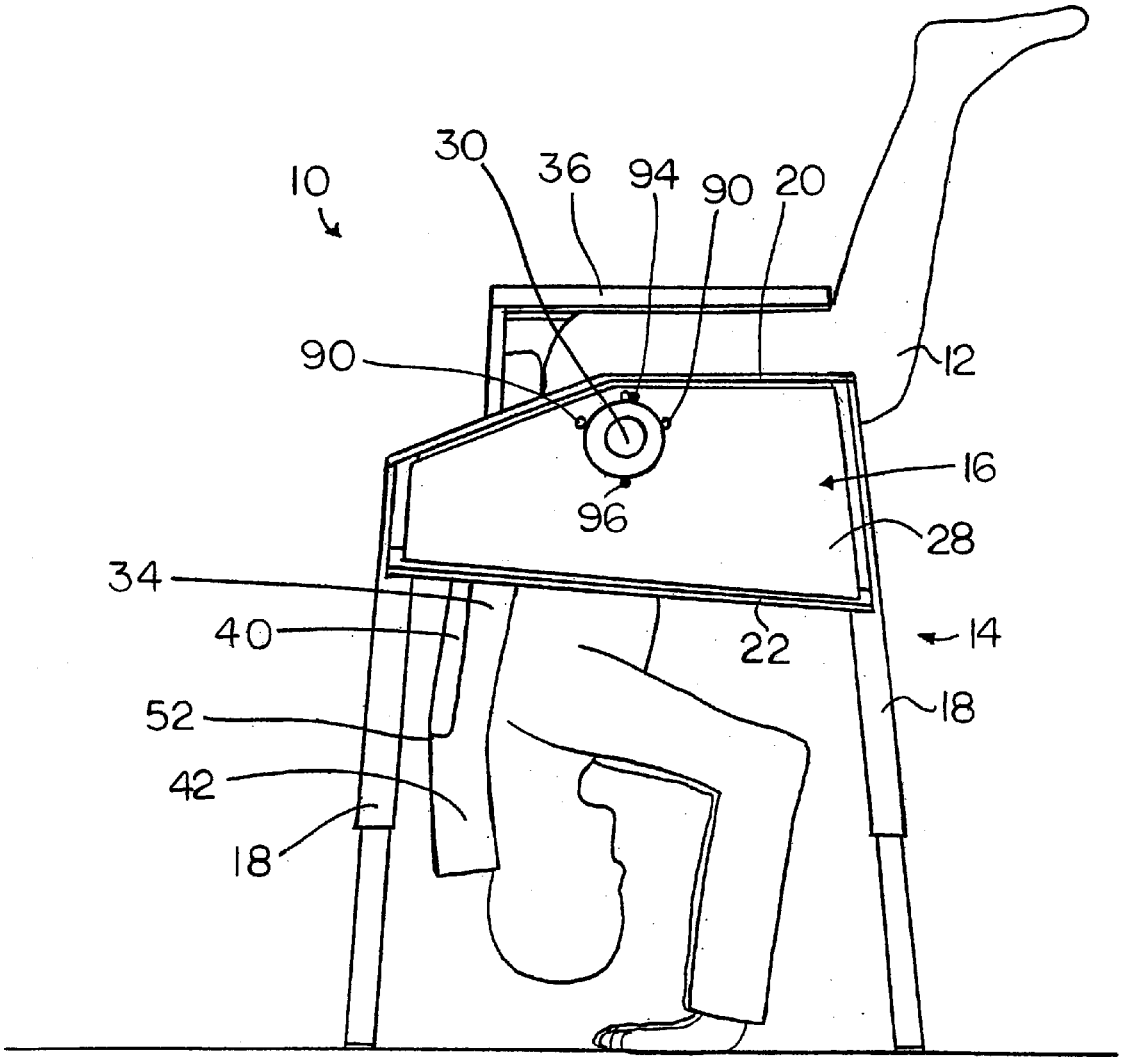
FIG. 2 is a side elevational view of the chair in an inverted position.
Figure 3:
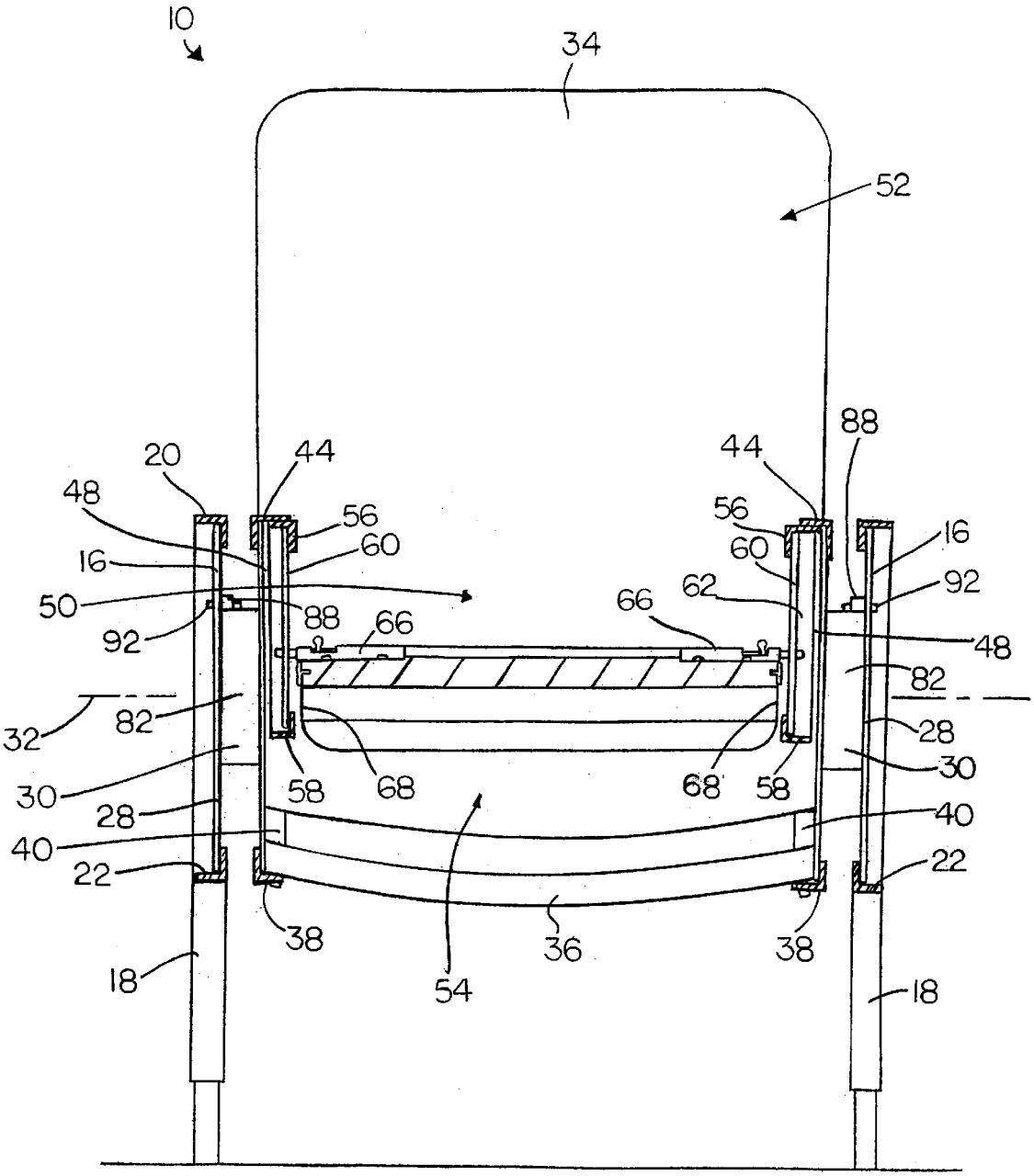
FIG. 3 is a partly sectional front elevational view of the chair.
Figure 6:
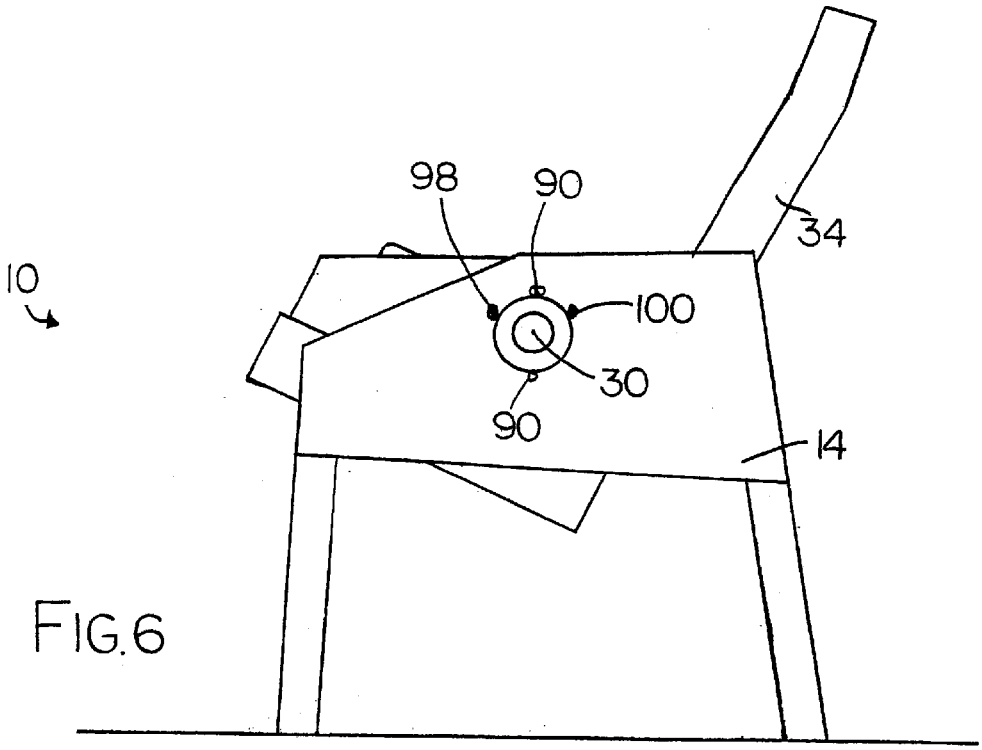
FIG. 6 is a side elevational view of the chair in a reclined position.
Figure 7:
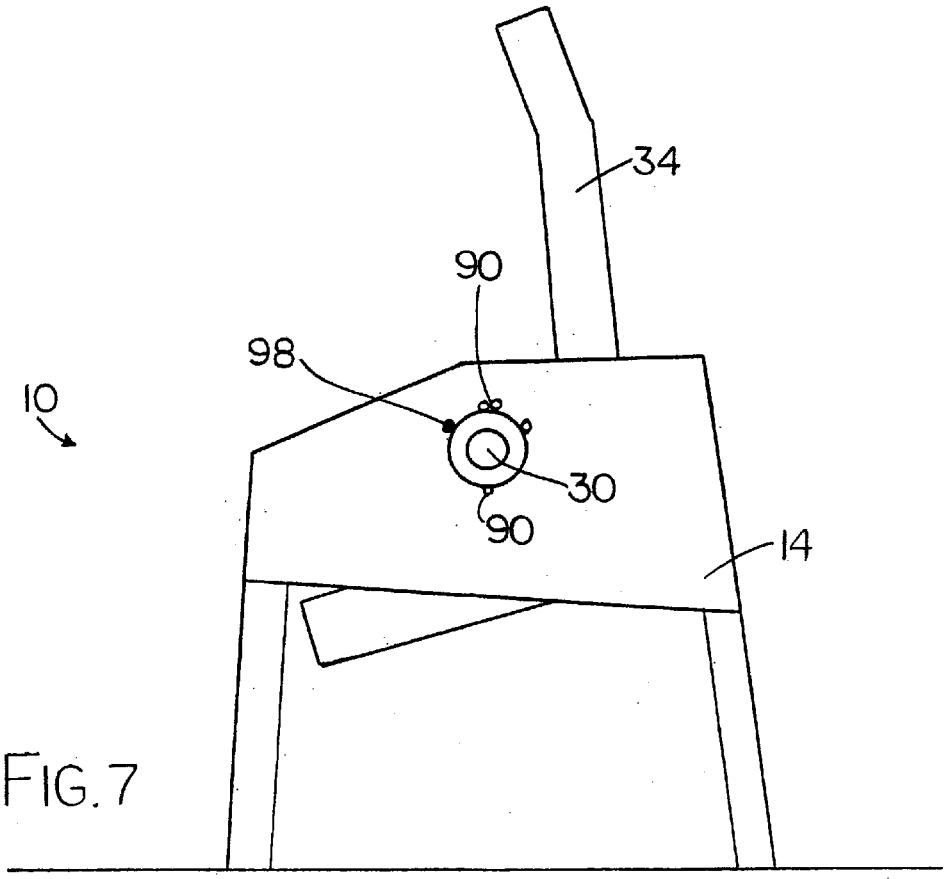
FIG. 7 is a side elevational view of the chair in a forward inclined position.

In this arrangement the chair may be used as a seat shown in FIG. 1, as an inversion chair as shown in FIG. 2, as rocking chair as shown in FIG. 6 or in a working position as illustrated in FIG. 7. In the seated position of FIG. 1 the locking member 92 is received through the aperture in the stop 88 and one of the locking apertures 90 corresponding to the seat and the person therein being generally upright.

When used as an inversion chair, upper and lower locking members 94 and 96 are inserted through respective locking apertures 90 which correspond to the end of travel of the seat when engaged with the stop 88 in the respective upright and inverted positions.

Similarly when used as a rocking chair, forward and rearward locking members 98 and 100 are mounted in respective locking apertures 90 to engage the stop 88 defining the end of travel of the seat's pivotal movement between a reclined position shown in FIG. 6 and a forward inclined position similar to that of FIG. 7. Further to the use as a rocking chair insertion of either of the forward or rearward locking members 98 and 100 through the corresponding aperture in the stop 88 on the pivot mount may selectively lock the seat in either one of the respective reclined or forward inclined positions. As illustrated in FIG. 7 the forward inclined position is particularly useful when working at a drafting table for example.

Figure 4:
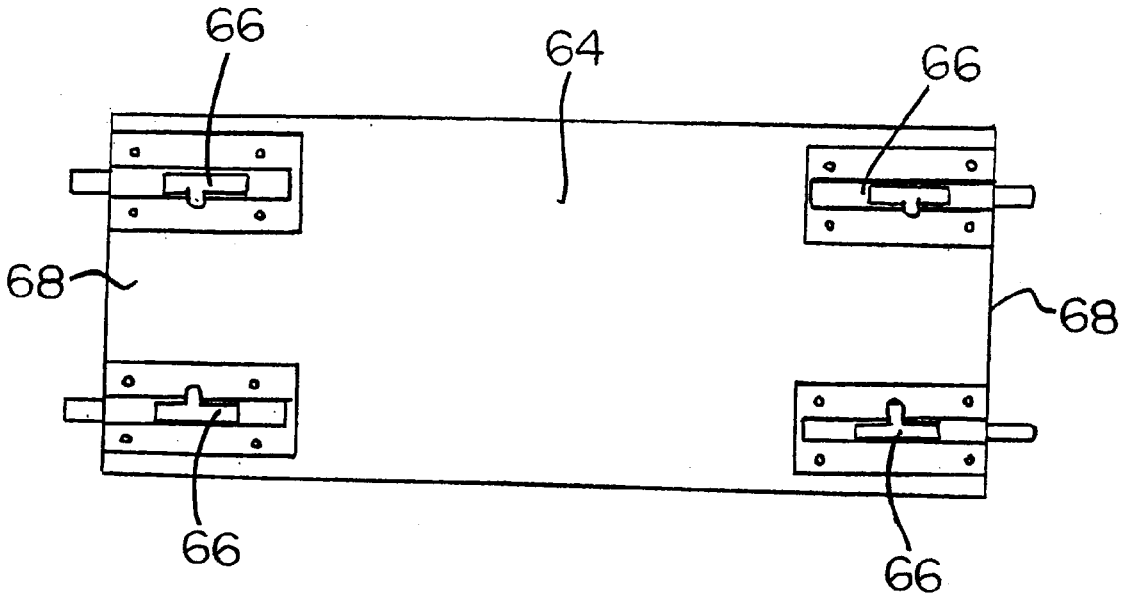
FIG. 4 is a top plan view of a lap bar for use with the chair.
Figure 5:
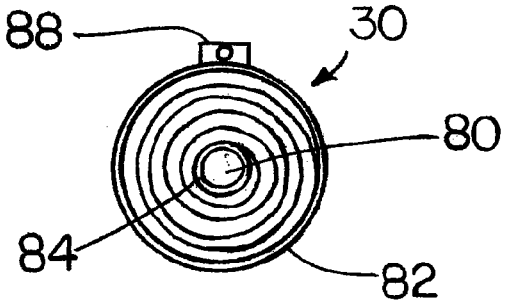
FIG. 5 is a sectional view of a pivot mount which supports the chair.

The chair as illustrated in the accompanying drawings is suitable for inverting a person supported thereon in a safe and controllable manner. A person first sits in the seat facing in a forward direction as illustrated in FIG. 1 and is restrained in the chair by the lap restraint illustrated in FIG. 4. The upper lock member 94 ensures that the seat is restricted from pivoting rearward and thus the person is inverted by pivoting the seat forwardly about the chair axis in the forward direction so as to face downwardly as the chair is pivoted. The damper and spring member on the pivot mount assist in pivoting the seat in a controlled manner.

Before pivoting the chair into the inverted position the leg members 18 are preferably extended as illustrated in FIG. 2 in relation to FIG. 1. The arrangement of the extendable leg members provides that the seat is at a suitable sitting height when used in the seated position of FIG. 1 while providing sufficient head room when extended and the chair is pivoted into the inverted position of FIG. 2. It may be desirable to use the lower locking member 96 inserted through the aperture in the stop 88 to lock the seat in the inverted position of FIG. 2.

The forward rotation of the seat from the upright position to the inverted position ensures that a fixed supporting structure either in the form of the frame of the chair or the ground is always within reach of the person using the chair. For example a person may first shuffle their feet along the ground to pivot the chair in a forward direction until the leg members 18 are within grasp. At this point the person may grab the leg members using their hands for further controlling the pivotal movement of the seat as their feet are raised from the ground. The person continues to urge the chair to pivot forward from the upright position until the chair is completely inverted at which point the person may easily reach out over their heads and touch the ground below them as illustrated in FIG. 2 to control the pivotal movement of the seat in relation to the frame.

Figure 8:
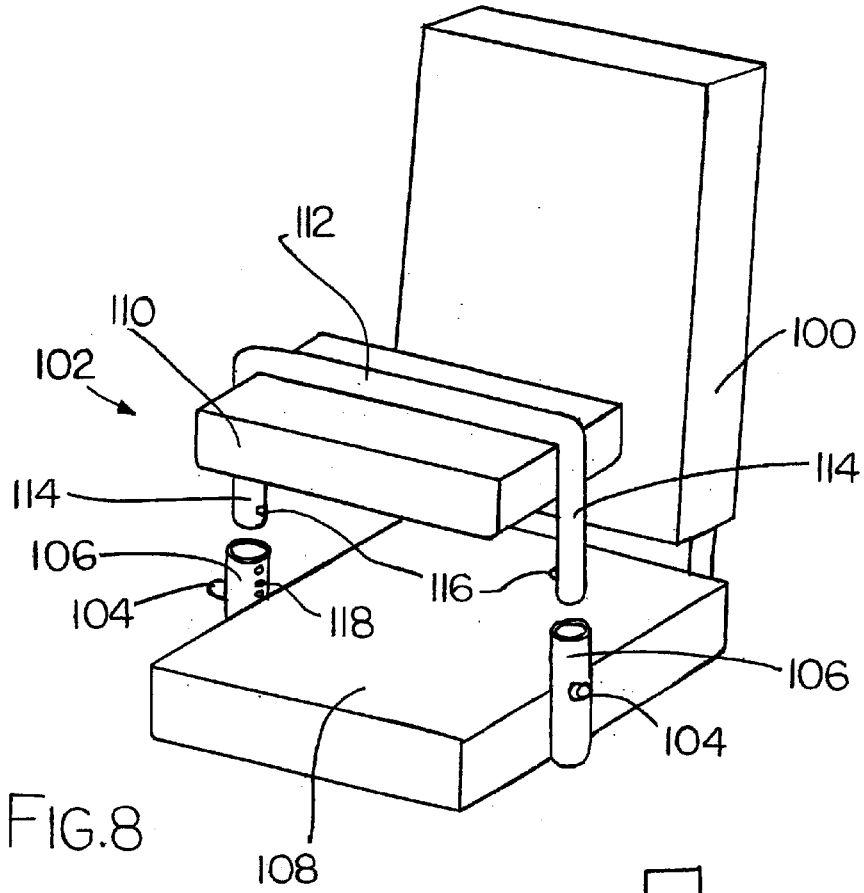
FIG. 8 is an isometric view of an alternative chair and lap pad design.

An alternative seat 100 and lap restraint 102 is illustrated in FIG. 8. The seat 100 is arranged to be supported by respective pivot mounts 104 on opposing sides of the chair for pivotal movement on a frame (not shown) similarly to the previous embodiment. The lap restraint 102 includes a tubular member 106 mounted to extend perpendicularly upward from each side of the bottom 108 of the seat 100. A lap pad 110 is arranged to extend laterally across a lap of a person supported in the seat 100 for mounting between the tubular members 106.

A mounting bar 112 extends laterally across a top side of the lap pad 110 and includes respective mounting portions 114 extending downward from each end of the mounting bar 112 at a respective end of the lap pad 110. The mounting portions 112 are arranged to be slidably received within the respective tubular members 106 on each side of the seat 100.

A spring loaded protrusion 116 on each mounting portion 112 is arranged to be depressed as the corresponding mounting portion is inserted within its respective tubular member 106 and then subsequently is deflected to project outwardly through one of numerous co-operating mounting apertures 118 in the tubular member 106 to secure the lap pad in place. The mounting apertures 118 are mounted at various vertical spacings along the respective tubular members 106 such that the lap pad may be mounted at any one of numerous heights in relation to the seat 100 by selecting which pair of co-operating mounting apertures 118 are arranged to receive the respective pair of protrusions 116 therethrough in a mounted position. Depressing the protrusions 116 release them from the respective apertures 118 for removal of the lap pad or to adjust the height of the lap pad.

Figure 9:
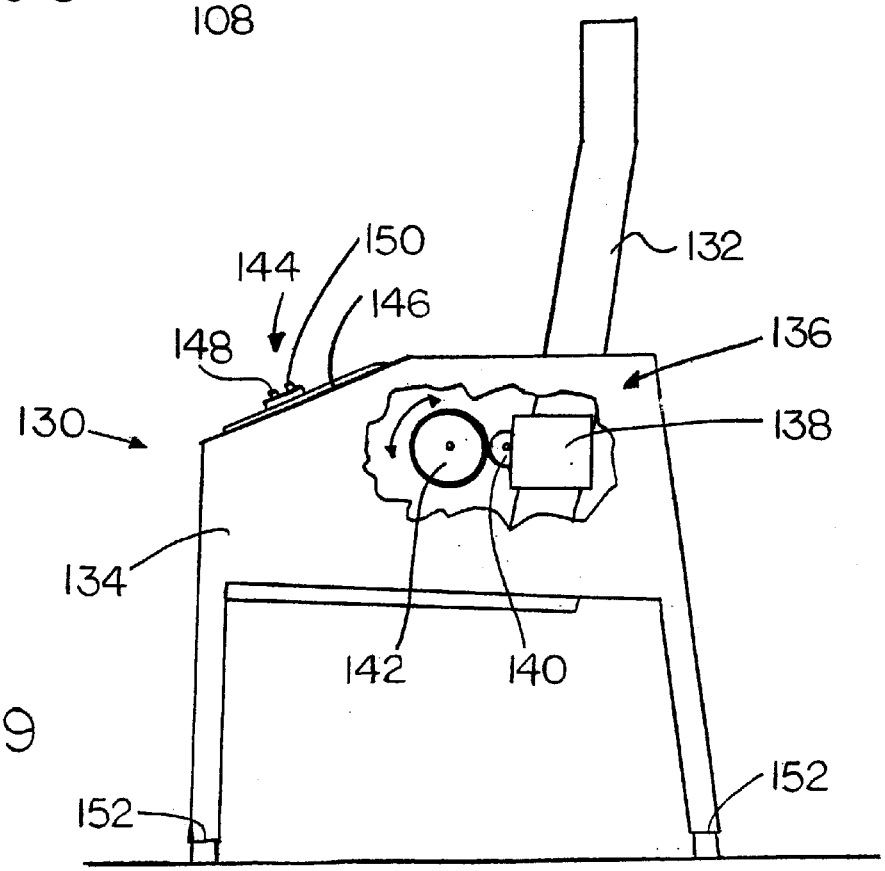
FIG. 9 is a partly section side elevational view of an automated embodiment of the chair.

An automatically operated embodiment is illustrated in FIG. 9 wherein there is provided chair 130 having a seat 132 pivotally supported on a frame 134 as in previous embodiments. The chair 130 includes a drive mechanism 136 coupled between the seat 132 and the frame 134 controlling pivotal movement of the seat in relation to the frame.

The drive mechanism 136 is enclosed within a housing built integrally with the frame 134 of the chair and includes an electric drive motor 138. The motor 138 includes drive gear 140 which is arranged to drive the rotation of a driven gear 142 coupled to rotate with the seat 132. Upon activation of the motor, the drive gear 140 rotates the driven gear 142 and the seat 132 together between the respective upright and inverted positions.

The drive mechanism 136 includes respective up and down controls 144 mounted on an arm rest 146 of the seat which is arranged to be inverted with the seat. The controls 144 are thus arranged to be accessible to a person supported in the seat through a full range of motion of the seat in relation to the frame. The controls include a forward actuation button 148 and a rearward actuation button 150 for selectively controlling forward and rearward pivotal movement of the seat in relation to the frame when the respective button is depressed for the duration of the rotation desired. Releasing either button 148 or 150 will stop the motor and thus brake the pivotal movement of the seat so that the seat may be stopped at any one of various position between the upright and inverted positions.

The drive mechanism further includes various modes of operation including rocking therapy in which the seat is automatically driven between the forward and rearward inclined positions and inversion in which the seat is automatically inverted forwardly in relation to the upright position a predetermined degree of rotation wherein the seat is restricted from further rotation by an integral stop mechanism which is adjustable to a range of desired angular rotations.

The drive mechanism also includes a seat lift mechanism in the form of actuators 152 on each leg of the frame 134 as described in the first embodiment. Upon activation of the drive mechanism to invert the seat 132, the controls 144 are arranged to raise the seat in the inverted position in relation to the upright position automatically as the seat is displaced between the upright position and the inverted position by the drive mechanism. The chair is thus arranged to support the seat at a normal sitting height for use as a conventional chair while providing sufficient head room when used for inversion.

While various embodiments of the present invention have been described in the foregoing, it is to be understood that other embodiments are possible within the scope of the invention. The invention is to be considered limited solely by the scope of the appended claims.

What is claimed is:

1. An inversion chair for inverting a person supported thereon, the chair comprising:

a frame;

a seat pivotally mounted on the frame for pivotal movement between an upright position and an inverted position in which the seat is substantially inverted relative to the upright position, the seat being arranged to support the person thereon;

a restraint coupled to the seat and being arranged to restrain the person within the seat as the seat is pivotally displaced from the upright position to the inverted position; and a stop member restricting rearward pivotal rotation of the seat from the upright position to the inverted position;

whereby the seat rotates forwardly and faces downwardly as the seat is displaced from the upright position to the inverted position.

2. The chair according to claim 1 wherein there is provided a locking member mounted on the frame arranged to engage the stop member, the locking member being selectively separable from the frame to permit displacement of the seat in both forward and rearward directions in relation to the frame when the locking member is removed.

3. The chair according to claim 2 wherein there is provided various mounting locations for the locking member each corresponding to a relative orientation of the seat in relation to the frame.

4. The chair according to claim 3 wherein there is provided a rearward locking member mounted on the frame arranged to engage the stop member in a reclined position in which the seat extends at a rearward incline in relation to the upright position and a forward locking member mounted on the frame arranged to engage the stop member in a forward inclined position in which the seat extends at a forward incline in relation to the upright position, the seat being arranged to pivot freely between the reclined position and the forward inclined position.

5. The chair according to claim 3 wherein there is provided a forward locking member mounted on the frame arranged to engage the stop member in a forward inclined position in which the seat extends at a forward incline in relation to the upright position, the locking member being arranged to restrict displacement of the seat in relation to the frame.

6. The chair according to claim 3 wherein there is provided an upper locking member mounted on the frame arranged to engage the stop member in the upright position for restricting rearward pivotal movement of the seat in the upright position and a lower locking member mounted on the frame arranged to engage the stop member in the inverted position for restricting rearward pivotal movement of the seat in the inverted position.

7. The chair according to claim 1 wherein the frame includes a lift mechanism arranged to raise the seat in the inverted position.

8. The chair according to claim 7 wherein the frame includes a plurality of legs supporting the seat thereon and the lift mechanism comprises an actuator associated with each leg for selectively extending a length of the leg to raise the seat.

9. The chair according to claim 1 wherein there is provided a damper mounted between the seat and the frame providing limited resistance to the relative pivotal movement therebetween.

10. The chair according to claim 1 wherein the seat is biased towards the upright position.

11. The chair according to claim 1 wherein there is provided a locking member arranged to secure the seat in the upright position.

12. The chair according to claim 1 wherein the restraint comprises a laterally extending support arranged to be secured across a lap of a person supported in the seat, the support including an adjustable mounting mechanism arranged to mount the support at various spacings in relation to the seat.

13. The chair according to claim 1 wherein there is provided a drive mechanism coupled between the seat and the frame controlling pivotal movement of the seat in relation to the frame, the drive mechanism including controls mounted on the seat which are arranged to be accessible to a person supported in the seat through a full range of motion of the seat in relation to the frame.

14. The chair according to claim 13 wherein the drive mechanism includes a seat lift mechanism arranged to raise the seat in the inverted position in relation to the upright position automatically as the seat is displaced between the upright position and the inverted position by the drive mechanism.

15. A method of inverting a person comprising;

providing a chair which is supported for pivotal movement about a substantially horizontal chair axis;

sitting the person on the chair to face in a forward direction;

restraining the person to the chair; and pivoting the chair about the chair axis in the forward direction from an upright position to an inverted position in which the chair is inverted about the chair axis in relation to the upright position such that the person faces downwardly as the chair is pivoted.

16. The method according to claim 15 including restricting pivotal movement of the chair in a rearward direction when the chair is in the upright position.

17. The method according to claim 15 including providing a damper on the chair arranged to partially resist pivotal movement of the chair.

18. The method according to claim 15 including biasing pivotal movement of the chair towards the upright position.

19. The method according to claim 15 including lifting the chair before it is pivoted into the inverted position.

20. The method according to claim 15 including locking the chair in the inverted position.

* * * * *